United States Patent [19]

Hyde et al.

[11] 3,984,032

[45] Oct. 5, 1976

[54] LIQUID FUEL DISPENSING SYSTEM

[75] Inventors: Peter John Hyde, Comberton; Peter Kendall Cripps, Cambridge; Donald George Buchanan, Bottisham; Robert George Spalding, Bracknell, all of England

[73] Assignee: Dresser Europe, S.A., Brussels, Belgium

[22] Filed: May 2, 1974

[21] Appl. No.: 466,519

[30] Foreign Application Priority Data

May 3, 1973 United Kingdom ..... 21140/73

[52] U.S. Cl. ..... 222/26; 235/92 FL; 340/151; 340/152 T

[51] Int. Cl.[2] ..... B67D 5/26

[58] Field of Search ..... 222/14–21, 222/25–28, 134, 136, 145, 32–36; 73/195; 137/88; 235/92 FL, 151.34; 340/149–151

[56] References Cited

UNITED STATES PATENTS

| | | | |
|---|---|---|---|
| 3,312,812 | 4/1967 | Schmitt | 222/14 |
| 3,641,536 | 2/1972 | Prosprich | 222/23 X |
| 3,705,385 | 12/1972 | Batz | 340/152 R |
| 3,706,086 | 12/1972 | Farnsworth | 340/151 |
| 3,756,463 | 9/1973 | Gravina | 222/26 |
| 3,781,534 | 12/1973 | Bruce-Sanders | 222/16 |
| 3,782,597 | 1/1974 | Hansen | 222/28 |
| 3,870,825 | 3/1975 | Roberts et al. | 340/152 R X |

OTHER PUBLICATIONS

Benedict; "Electronics for Scientists and Engineers," 1967; pp. 584–587.

*Primary Examiner*—Robert B. Reeves
*Assistant Examiner*—Joseph J. Rolla
*Attorney, Agent, or Firm*—William E. Johnson, Jr.

[57] ABSTRACT

A liquid fuel dispensing system having a plurality of dispensing pumps each generating electric pulses according to the volume of fuel dispensed and a central control where payment is made. A data transmission link couples each pump to the central control and each pump has a pulse store which accumulates pulses generated by the pump during a dispensing operation. A multiplexing unit at the central control samples the outputs from the pulse stores which are updated at each sampling.

11 Claims, 10 Drawing Figures

LIQUID FUEL DISPENSING SYSTEM

The invention relates to a liquid fuel dispensing system as may be used for example, at a road-side petrol filling station. In particular, the invention relates to a system comprising a plurality of dispensing pumps controlled by a central control where payment may be made. Generally, the pumps will be of the self-service kind where the customer himself dispenses the fuel.

In such centralized control systems it is necessary to transmit data to the central control from each pump representative of the quantity and perhaps the value of fuel dispensed. Also, in systems where it is possible for the customer to select one of a number of grades of fuel it is necessary to transmit information concerning the grade selected. It has been proposed to equipment the fuel meter at the pump with an electric pulse transmitter which transmit a pulse to the central control as each unit volume of fuel is dispensed. The pulses are received at the central control where they are counted and calculation is made to determine the cost of the transaction. Such systems suffer from the disadvantage that electrical interference picked up on the data transmission lines between the pumps and the central control can be interpreted as volume or money pulses and give a faulty indication at the central control. The present invention seeks to provide a system in which this disadvantage is alleviated.

According to the present invention there is provided a liquid fuel dispensing system comprising a plurality of liquid fuel dispensing pumps each having a fuel meter, an electric pulse transmitter associated with the fuel meter of each pump to generate pulses representative of the volume of fuel dispensed, a central control, a data transmission link between each pump and the central control whereby information may be transmitted from the pump to the central control representative of the volume of fuel dispensed, a pulse store at each pump which accumulates pulses transmitted by the associated pulse transmitter in a dispensing operation, and sampling means at the central control which repetitively samples the outputs from the pulse stores to derive inputs representative of the volumes dispensed, which inputs are updated at each sampling. With this arrangement interference on the data transmission link received whilst a sample is being taken may upset the input to the central control. However, the error will be rectified in subsequent sampling.

While it is envisaged that this system may be applied where the data links are individual pairs of transmission lines between the central control and respective pumps, further benefits are achieved by use of a multiplex transmission system over a single data path. The multiplex system may be frequency multiplex but is preferably time-division multiplex. With individual transmission paths for the pumps or with frequency division multiplex it is possible to effect sampling of the different stores simultaneously in a parallel manner. However, it is preferred, and with time-division multiplex is necessary, to effect sampling cyclically in a serial manner. Thus, in a preferred embodiment of the invention the data transmission links comprise a common data path, time-division multiplex means are provided, the sampling means comprises an interrogator which cyclically interrogates the pump pulse stores and the pump pulse stores have associated responders which respond on being identified in the interrogation to transmit information from the pulse store to the central control.

The use of a single transmission link allows the system to be installed with the minimum of physical disturbance and cost, since the lines coupling the pumps to the central control may need to be laid in the concrete floor of the station. Even greater benefit is achieved if, as is preferred, the common transmission link is constituted by the power lines which provide electric current for the pump motors. Data transmission over the power lines is effected by establishing a high frequency carrier which is modulated by the data signals and demodulated at the central control. The mains supply system may be a ring main system or it may be a star system in which the supply lines for the pumps radiate from a common point. It is to be understood that the use of a star system does not detract from the concept that the data link is common to all the pumps, being the star main system in this case.

The system described thus far is applicable to pumps of a simple single-grade kind. Such pumps are in use at the present time but there is a tendency to replace them by blending pumps which blend two base grades of fuel together in a ratio chosen by the customer to give a preselected grade of fuel. However, it is a feature of the present invention that the system is compatible with single grade pumps and blending pumps. The single grade has a mechanical drive for driving indicator drums representative of volume of fuel dispensed and the total cost of the fuel dispensed. It is proposed with such a pump to drive the pulse transmitter from the drive for the cost drum and to provide a pulse store for those pulses, the accumulated cost total, which is representative of volume, being transmitted to the central control. At the central control a calculator is provided to derive a representation of volume dispensed from the cost information from the pump. The calculator is pre-set with the unit price of the grade concerned.

Apart from the foregoing example of a mechanical single-grade pump, it is preferred that the system should be such that volume and cost calculations, as well as information storage should be effected at the pump instead of at the central control. This allows the pumps a degree of independence of the central control so that in the event of failure of some part of the central control the pumps may be operated conventionally. Also, in the event of failure of part of the calculating equipment only the pump concerned is affected and the remainder of the system can continue to be used.

The system is applicable to mechanical blending pumps in which blending control is effected by a mechanical differential responsive to any discrepancy from a pre-set value of the ratio of movement of two meters in the respective fuel lines. However, the system is also applicable to a blending pump in which blending control is effected in response to an electrical error signal.

Preferably the pulse store at the pump comprises a recirculating shift register which carries the totals of pulses representative of volume dispensed and cost.

The provision of volume and cost indication in updated digital form conveniently allows the use of an electronic digital display at the pump. The display may employ seven-segment digital indicators mounted on the body of the pump. Additionally, or instead, a similar display may be arranged on the dispensing nozzle itself. A system for monitoring the display to detect faulty segments is proposed.

It is necessary for the current unit price of fuel to be displayed. Also, it is desirable to be able to change the current unit price quickly at will, perhaps adjusting the price in accordance with the time of day, for example. In order to do this a unit price display at the pump can be arranged to be controlled by signals from the central control and the displayed information can be up-dated in every cycle of the repetitive sampling scan.

Provision is made for interfacing the system with a wide range of peripheral units. The general philosophy is that all the pump data is available on the data path, and that any peripheral unit which needs this data can obtain it through an adaptor unit connected to the data path. Specific consideration has been given to the use of note readers, cash registers, trading stamp issuers, printers and credit card acceptors, but since all of the system information is available in the central unit, any peripheral unit which requires this information could be accommodated.

The invention will further be described with reference to the accompanying drawings, of which:

Figure 1:
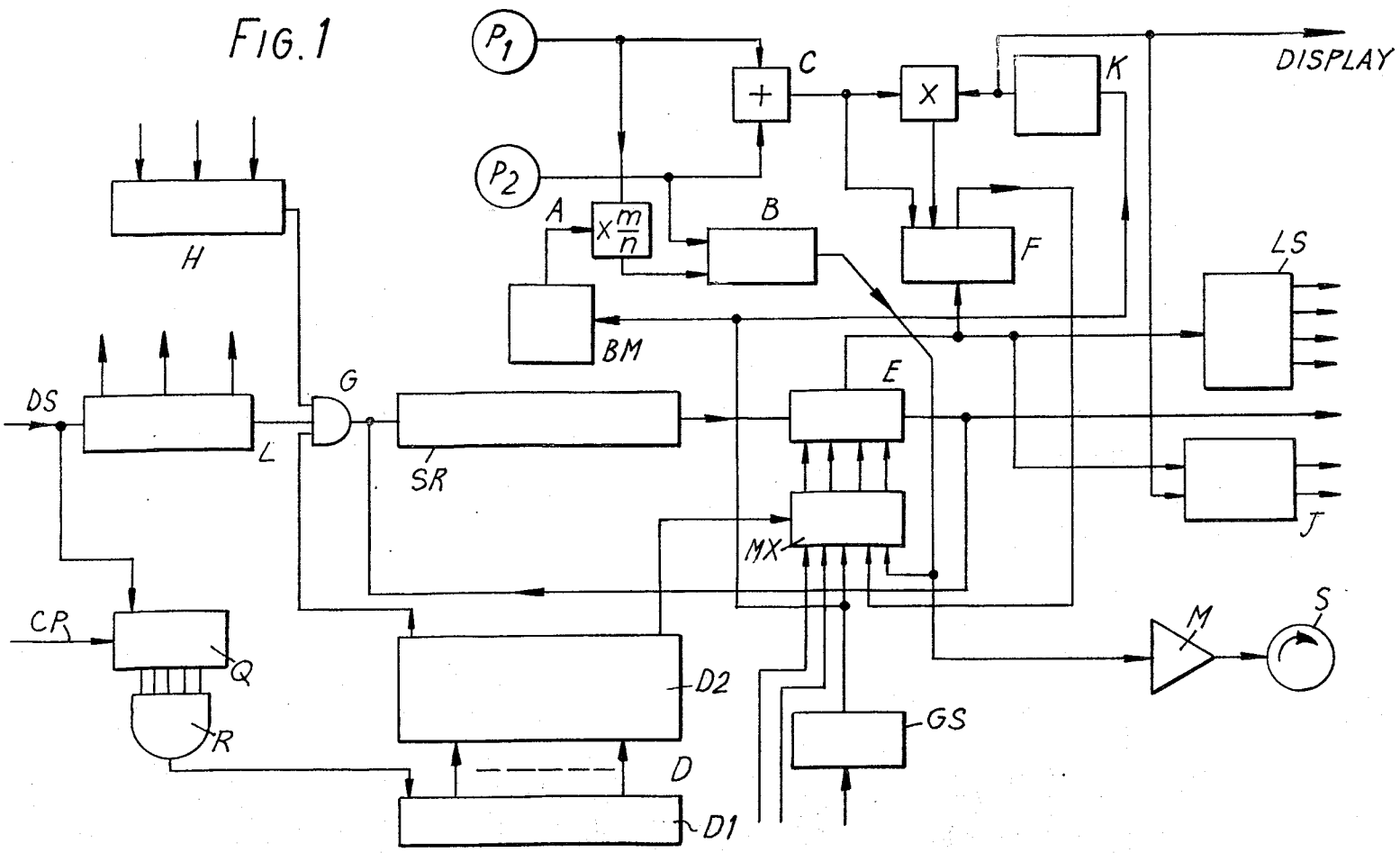
FIG. 1 is a block schematic diagram of an electronic blending petrol pump for use in a system according to the invention.

In the drawings there are shown component parts of a system in accordance with the invention, where there are a number of petrol pumps and a common central control where a cashier takes money after a customer has served himself with petrol. Information is transmitted from the pump to the central control during the dispensing operation to be displayed for the cashier.

Referring to FIG. 1 the pump to be described is an electronic blending pump which blends two base grades of petrol in a selected ratio. Two pulse transmitters P1 and P2 are associated with meters in the respective fuel lines and give one pulse for each unit quantity (e.g. 0.005 gallons) of high and low grade fuel respectively which is dispensed.

If the two grades of fuel are required to be blended in the ratio $m$ units of high octane to $n$ of low, the low octane pulse train is frequency multiplied by the factor $m/n$, using a binary rate multiplier A. The resultant stream of pulses cause a counter B to count upwards, whilst the high octane pulse train, which is applied directly to counter B, causes it to count downwards. When the flow rates are properly adjusted the mean content of counter B is zero. The state of counter B is converted to analog form and this is used to control the angle of a mixing value which controls the proportion of high to low grade fuel in the mixture which is dispensed. The mixing valve is controlled by a servomotor S which is driven by an amplifier M which amplifies the analogue signal from counter B. The servo loop is such that the mixing valve is driven in a sense which always tends to reduce the error signal from counter B to zero. Obviously, when either pure high or pure low octane fule is required this method of blending control is inappropriate, and so the mixing valve is arranged to be driven to one or the other of its limits of travel.

The current state of the error counter B is also stored for transmission to the central control; the value of the cumulative blending error at the end of the delivery, together with a knowledge of the nominal blend and the total volume of fuel dispensed, enables the constituent volumes to be calculated precisely at the central control, for inventory purposes, without the need for their separate sampling, storage and transmission.

In the case of a pump with mechanical blending, separate pulsers will still be fitted to each of the two constituent petrol lines. The multiplier A and error counter B are retained for the inventory purpose described above, although the servo loop is not closed, control of the mixer valve being by way of the mechanical blending computer. It is necessary to ensure that the ratio $m/n$ programmed into A corresponds exactly to the gear ratio used in the mechanical blender.

For pumps with no provision for the mechanical calculation of cost, the two streams of pulses representing the flows of high and low octane fuel are synchronised with a clock and combined into a single train, representing the total flow, in the serial pulse adder C. Using a binary rate multiplier of the type incorporated in the blender this pulse train is then converted to the appropriate money units for storage in the pump and transmission to the central control.

If the pump to be used has mechanical cost calculation facilities a pulser producing a money unit pulse train is attached to the gear train driving the mechanical cash indicator.

Figure 2:
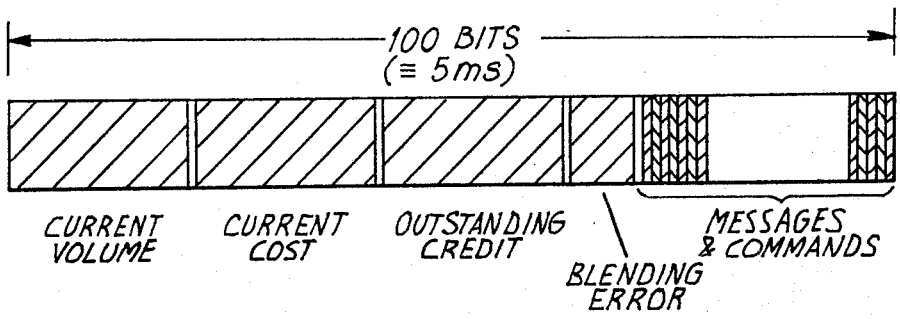
FIG. 2 is a diagram illustrating the organisation of information storage in the pump store of FIG. 1.

Data and instructions storage facilities for the pump are provided by a continuously recirculating shift register SR about 100 bits in length. Except for the short sections required for access, this device consists of a single MOS package. The proposed organisation of information in the store is shown in FIG. 2: twenty bits are allocated to each of current volume, current cost and outstanding credit (i.e. 5 decimal digits each in BCD format). The remainder of the store is for the storage of incoming instructions from the central control, for outgoing messages and status signals originating in the dispenser, and a signal corresponding to the selected grade. Some spare space is available in the store for messages and commands as yet unspecified.

Accessing and arrangement of information in the store is under the command of a 12 bit counter and decoder D. This controls an input gate G for the shift register. The unit D comprises a 12 bit counter D1 and a decoder D2. The counter is synchronised to the central control by means of a long pulse of logical ones transmitted by the latter; this can be differentiated from data because no data word or command will contain a continuous sequence of logical ones greater than about eight bits in length. Setting and synchronisation is effected by a counter Q having an OR gate R at its output which applies setting pulses to the SET inputs of the counter D1. Counter Q is fed by clock input pulses CP and is cleared by the appearance of a logical 0 in the incoming data signals DS from the central control.

Thus, control counter D causes the shift register to accept incoming instructions and data from the central control at the time appropriate to the particular pump; similarly it energises a multiplier unit MX to ensure that information is passed back to the central control at the proper time.

Local accessing of information is also controlled by counter D, and this is done by using the 4 bit parallel in/parallel out shift register E. The current dispensed volume and its value are updated once per cycle of the store (i.e. once per 5 ms) by either adding or not adding one unit to the stored number, depending upon whether a new pulse appeared during the preceding cycle or not. This addition is performed by a BCD adder F, taking one decade of the number at a time. This arithmetic element also functions as a subtractor to decrement the pre-selected or prepaid cost figure which is inserted in the store at the beginning of a transaction. This is effected by a manual control operated by the customer at the start of the dispensing operation whereby he selects the value of fuel he wishes to be dispensed. Shift register E is also used for entering grade and status signals into the store, and for extracting commands from it. A grade input to shift register E is applied from a grade store GS which is set in accordance with the grade selected by the customer. An output from the store GS is applied to a blend random access memory BM which is effective to set the multiplier A in accordance with the blend selected. An output from register E is applied to adder F, comparator J, to be described, and to a series of latch switches LS which control the pump motors.

Incoming data and instructions from the central control are entered serially via the gate G, from the data link. When the pump is to be used in the normal post-payment mode the preset cost, set by the customer into a local cost store H, is also entered serially.

In dispensing a preset quantity of fuel it is necessary that the delivery rate of the pump is reduced to a low level just before the end of the delivery. In this system this requirement is satisfied by comparing the remaining credit figure contained in the store with a number directly related to the price per unit volume, using the comparator J. It will be seen that this arrangement shows the pump at a time dependent on the volume of fuel remaining and independent of the grade or cost. This comparator is also arranged to detect the end point, i.e. zero remaining credit, thereby instructing the pump to stop.

The current price and blending ratio of each grade of fuel is stored in a random access memory K. Since it is required that the price structure should be under the command of the central control, to facilitate automatic modification according to the hour of the day or day of the week, this memory is updated with current prices originating in the central control once for each complete cycle of the pumps. This information appears in register L, outside the main memory loop, one price at a time, and is simultaneously entered into the memory of every pump. The connection from register L to memory K is not shown in the drawing. The connection from grade store GS to memory K is shown. The unit price output from memory K is applied to operate a display and also to comparator J. This output is also multiplied in a multiplier X with a signal representative of volumes dispensed to give a current cost output to the adder F.

To prevent the possibility of the price or blend being changed whilst a transaction is actually in progress, logic is provided to inhibit updating when the pump is in use. In the event of a failure of the central control or the data link the price and blend structure current at the time of failure is thus securely stored within the pump. In the unlikely combination of events of a central control failure followed by a temporary mains power failure, the information in the price structure memory would be lost, since the devices to be used require continuous electrical power for operation. For this eventuality, the petrol station supervisor is provided with a small, portable programming unit, which is plugged into each pump in turn and would program the memory with the required information.

From an ergonomic point of view, the most attractive display system is one which is located at the pump nozzle. This will show current volume, current cost and price per unit volume, although the last could be duplicated at the dispenser for easy viewing by the customer as he is selecting the grade of fuel he requires.

Figure 3:
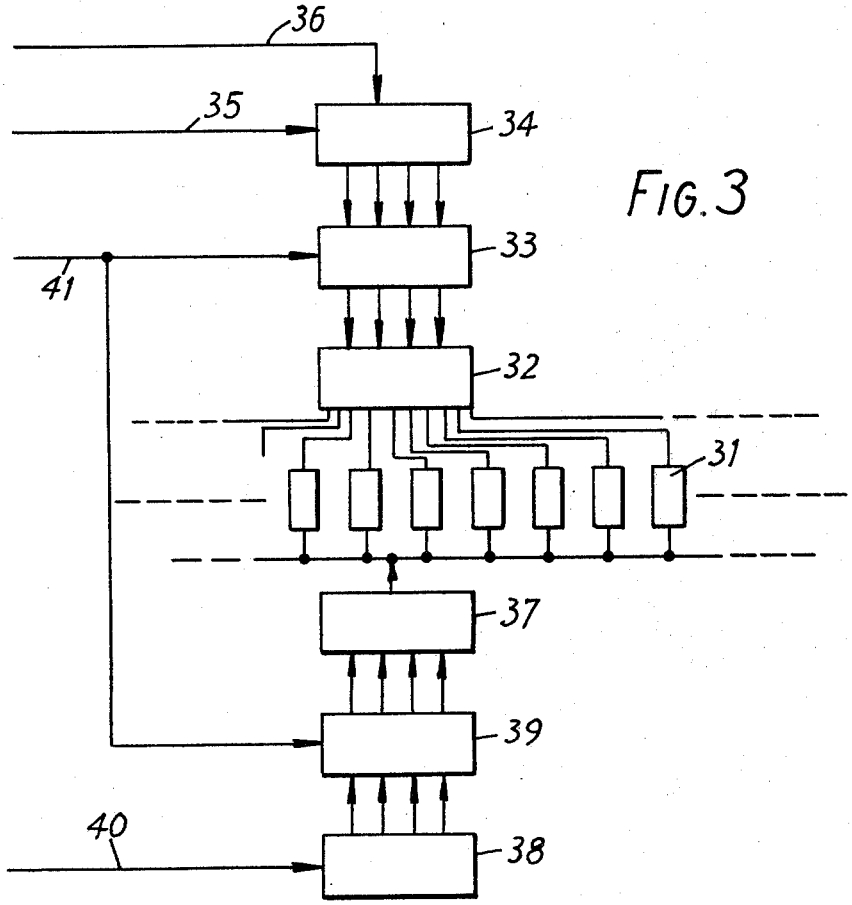
FIG. 3 is a circuit diagram of the display system of the pump of FIG. 1.

A block diagram outlining the proposed display system is given in FIG. 3. The display arrangement comprises thirteen seven-segment display devices 31 each having a common anode and seven cathodes. Simultaneous energisation of the anode and selected cathodes of a device gives an appropriate numerical display. The thirteen characters are arranged in three groups which represent respectively the unit price of the selected blend, the volume dispensed and the cost of the fuel dispensed. In order to keep to a minimum the number of input leads required for the display arrangement a time-division multiplex driving system is employed. The thirteen anodes are energised in cyclic sequence by a character selector 32 which is set through a latch 33 in accordance with the output from a four-bit counter 34. The counter is set by pulses on an input line 35 and cleared by pulses on an input line 36.

The cathodes of the display devices are selectively energised by a seven-segment decoder 37 which has seven parallel outputs, although for convenience they are shown grouped together as one lead. The decoder is set by a four-bit register 38 through a latch 39. The register 38 is set by pulses on a line 40. The latch 39 is controlled in synchronism with the latch 33 by pulses received on a lead 41. The multiplex arrangement is such that as the energising potential is charged from one anode to the next, so the code is applied to decoder 37 is charged. Thus, each device gives its respective required display.

For safety purposes the entire display and associated logic are completely encapsulated in a transparent block of epoxy resin. A non-exposed metal heat sink is used.

Means are provided for checking the satisfactory operation of all segments of the display to warn the cashier if a fault develops. This is done by measuring the current passed by a nominally 'on' segment, and if it does not reach a prescribed value, the segment is deemed to be faulty, whereupon a signal is transmitted to the central control. One signalling wire between the display and the pump will enable this to be done.

Whilst it is probable that the existence of a fault in the system would rapidly become apparent in the normal course of operation of the station, the relative complexity of the electronics used, and the consequences of failure make it highly desirable that faults should be located and diagnosed with all possible speed. The service engineer is therefore provided with a testing unit which can interface with the pump at the data link and pulser inputs and provide test signals that simulate these inputs for a wide variety of conditions. Then by monitoring the transmitter and local display outputs it should be possible, with the aid of a fault finding chart, to determine at least the approximate location of a fault. It is anticipated that on-station servicing would be limited to exchange of printed circuit boards.

Since all calculations and short term storage requirements are provided at the pumps, the function of the central control unit reduces to that of monitoring the status, money, and volume contents of the pumps, of generating commands for the pumps, and of providing long term non-volatile storage of cumulative volume and cash totals. The functions of each section of the control unit and console are now explained with reference to the block diagram of FIG. 4.

A control counter and decoder, A4, similar to, and synchronised as already described with those units D (FIG. 1) in the dispenser units controls the routing of messages and data into and out of the central unit. Separate registers B4 and C4 respectively are provided for data received and data to be transmitted. Register C4 is supplied through a multiplex unit MX4 and register B4 drives a buffer unit BF4. Thus inputs are made, and outputs taken from the data link at times defined by the control counter A4. A keyboard K4 is operated by the cashier and provides an input to unit MX4. The system is arranged so that pressing the selector key on the keyboard for a particular pump causes that pump to be held until another is selected. Messages put into the system will then be transmitted exclusively to the selected pump.

The function of the cashier's display consol is to indicate simultaneously the status of all the pumps, and to duplicate the current volume and cost indication of one or more selected pumps. The status at each pump is indicated by two lamps L4, with an extra lamp to indicate the presence of a stored previous transaction, where this facility is provided. In addition to this a single numerical display ND4 of 13 decimal digits for current volume, cost and price per unit volume is provided. This display indicates for the pump defined by the last selector key pressed. On a large installation two or more such display systems with their associated keyboards may be provided so that multiple operators can be used. Lamps L4 are driven from buffer BF4 through a latch LT4A and a decoder DC4A. Display ND4 is driven from buffer BF4 through a latch LT4B and a decoder DC4B.

An alternative form of display is a modular device, each module consisting of status lamps and numerical displays dedicated to a particular pump. This system will clearly be more expensive than that described above, but it may be attractive on very small installation with a single operator, or on larger installations with multiple operators who would then share the display, but have individual keyboards.

Figure 4:
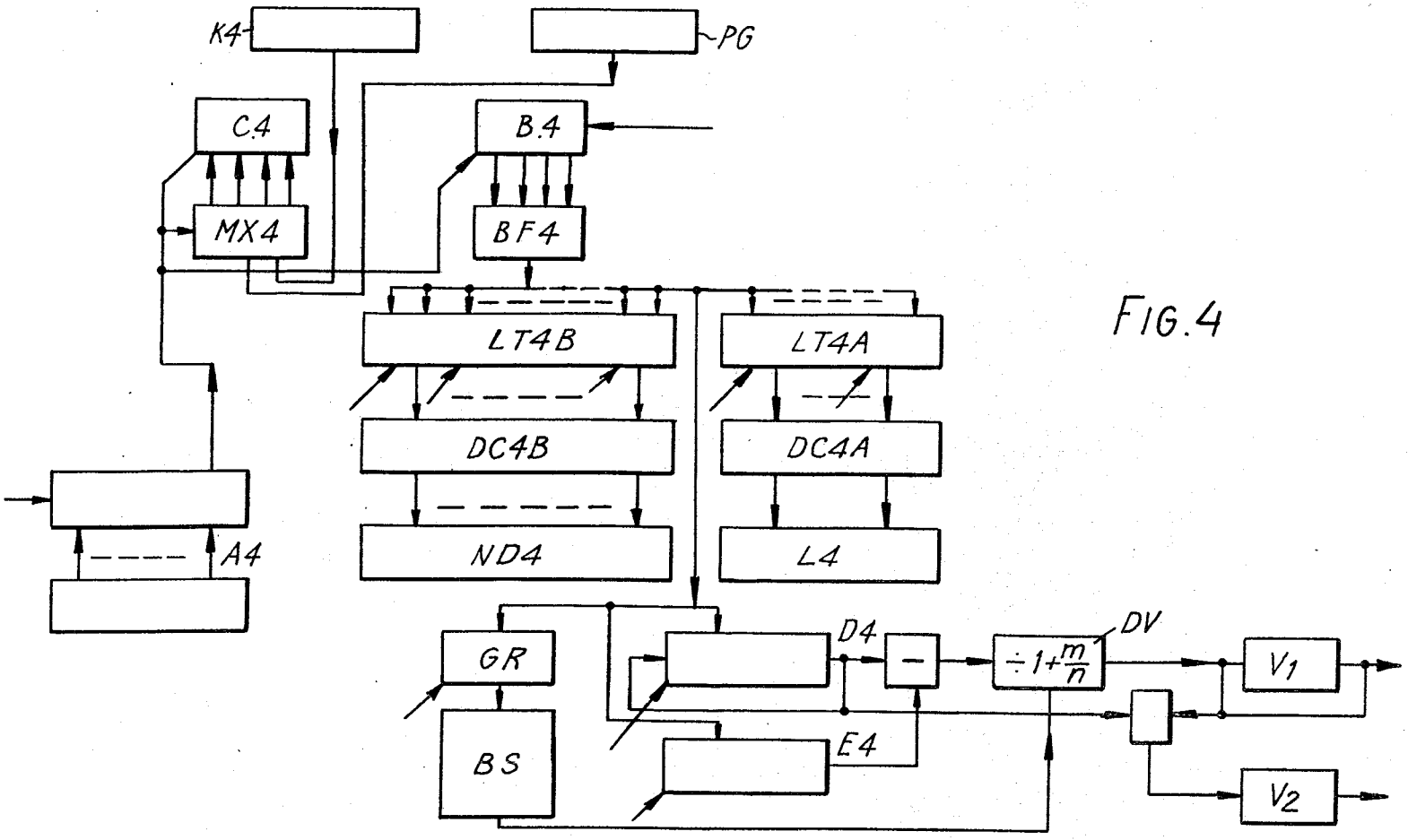
FIG. 4 is a schematic block diagram illustrating the logic circuit of the central control unit of the system.

The console system indicated in FIG. 4 uses a single numerical display. Input information for this is taken from the input register one decimal digit at a time and the latches acting as the display store are energised at the appropriate times by the control counter.

The keyboard consists of one selector key for each pump, and common command keys providing the functions pump release, individual pump stop, general stop, store current transaction, intercom open, etc.

This device generates for transmission to the pumps the price per unit volume and blending constants for each grade, and may be provided with facilities for setting two or more price structures, together with a clock unit which selects the current structure according to the time of day. The prices of each grade are set on decade thumbwheel switches on a price generator PG.

The cumulative totals within any period for cash takings, volumes of each grade, and volumes of the high and low octane components are stored on electromechanical counters. This method ensures that even in the case of a total power failure the information is not lost.

The cash value at the end of a transaction is directly available, as is the volume of the blend sold, and it is only necessary to arrange means of buffering these inputs so that they are applied at a rate compatible with the electromechanical counters.

The final dispensed volume of blended fuel is entered into a register D4 and the blending error into register E4. The error is subtracted from the total volume to give the time value $n + m$. This is divided by the factor $1 + {}^{m}/n$ in the dividing circuit DV which is set with the appropriate factor by a blend store BS which is controlled by a grade register GR. The output from divider DV is the value $n$ which is applied through a buffer V1 to an electromechanical store. The value $n$ is also subtracted from the output from D4 to give $m$. This is applied through a buffer V2 to another electromechanical store.

Certain peripheral devices to be used with the system, such as prepayment systems, cash registers and trading stamp dispensers can be predicted, but it is the essence of a flexible system that it should be able to accommodate devices as yet unspecifiable. Therefore it is the objective of this design to make all of the information carried on the data channel available to a peripheral device, together with adequate room for inserting new instructions in the data sequence. It is intended that each peripheral unit should be provided with a printed circuit card which would be plugged in to the central unit. This card would be provided with a 12 bit counter and decoder similar to that in the central unit, and synchronised to it, which would select the required information from the incoming data stream and store it in a form suitable for the particular peripheral. Similarly, data and instructions may be inserted into the outgoing data channel for transmission to the pumps. For instance, a prepayment device would have to provide an instruction to release the pump for use, an instruction to disable the normal method of preset price selection, and a data input to insert the prepaid price into the pump memory.

Under particularly busy conditions it may be advantageous for the cashier to release a pump to a second customer before the first has paid. For this purpose it is possible to provide an optional storage facility (not shown in FIG. 4) into which the cashier can enter the pump readings at the end of the first transaction and readdress these for display on the numerical indicators at a convenient time.

The store would probably take the form of a simple recirculating shift register with 4 bit input and output facilities, controlled by a 12 bit counter and decoder similar to that already used. Additional common keys would be provided on the keyboard for information entry and retrieval, and an extra status indication lamp would show the presence of stored readings.

Three main types of communication are required; two way data transmission between pumps and the console, time synchronising signals, and audio intercom signals. As mentioned above, data transmission takes place on a time-sharing basis, requiring only one communication channel.

Existing pump power supply lines are used to transmit high frequency carriers modulated with the required information. A centre frequency of 120 kHz has been chosen for the data channel, and with a data rate of 20 kilo bits/second (20 kb/s), the band 100 kHz to 140 kHz will be occupied. The 20 kHz timing signal can conveniently be transmitted directly down the line. The frequency is rather low for effective line interference filtering, but since no modulation of the 20 kHz signal is envisaged, narrow receiver filters can be employed to provide an acceptable signal/interference ratio.

The two way intercom frequency is located between the clock and data channels. The frequency chosen, 47.5 kHz, ensures that intercom harmonics do not fall within the data band.

Figure 5:
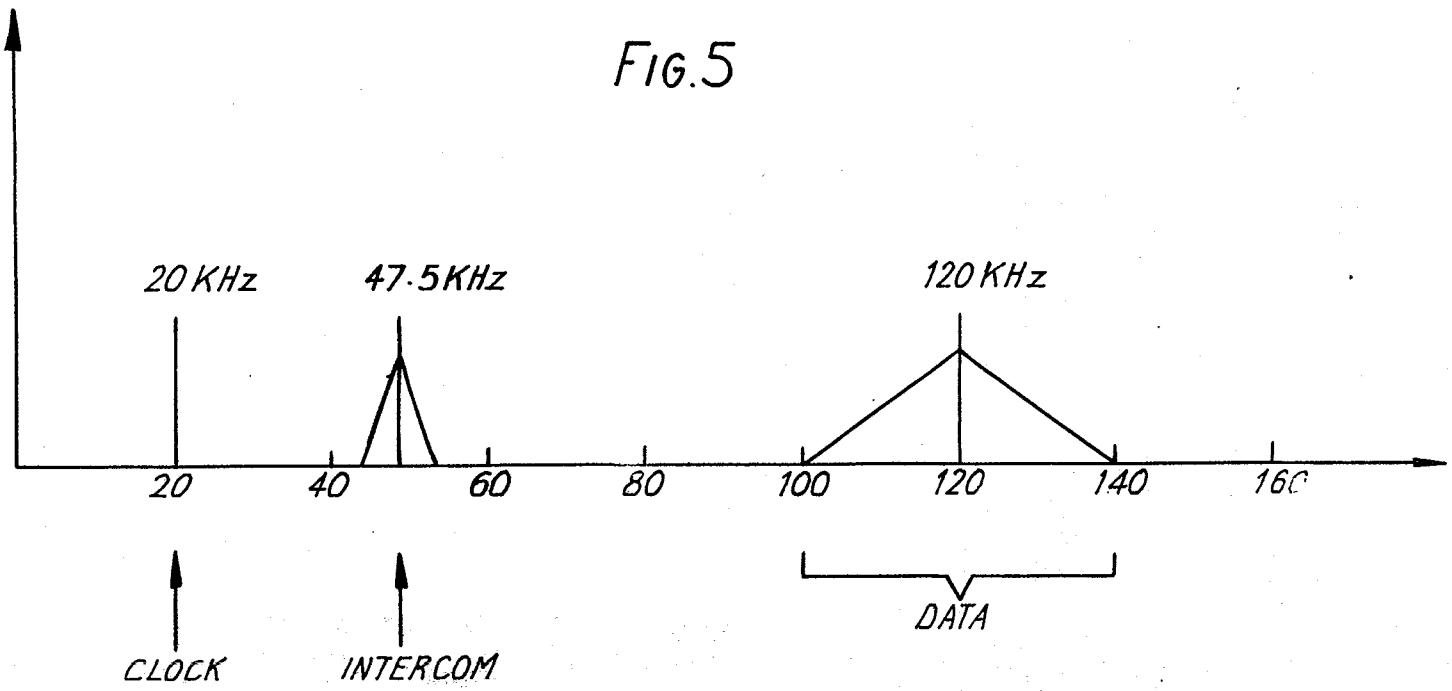
FIG. 5 is a diagram illustrating the frequency allocation for signals in the system.

FIG. 5 summarises these frequency allocations.

In many countries, pump power wiring is on a "star" system, where each pump is individually supplied, switched, and fused. However, "ring main" connection is not unknown, and the communications link has been designed to allow for either mode of connection. This is clear from FIG. 6, which shows the basic block diagram. It will be observed that the communications "unit" is identical for both pump and console installations; this has obvious advantages in manufacturing and spares stocking.

The data link is such that all receivers respond to whichever transmitter is in use. As described in the previous section, pump and console logic units are designed to ignore signals unless specifically directed at them, and data is only generated within a predetermined time slot. This parallel connection of transmitters and receivers is therefore acceptable, and adds considerably to the flexibility of the system, since any peripheral unit may be added, providing it has access to the station mains supply.

The intercom transmitters IT and receivers IR are also connected in parallel. They are all normally inhibited from operation, but individual transmitters and receivers may be switched on via the data link from the console. Thus, a customer wishing to use the intercom would press the alert button on the pump, which would cause a light and/or buzzer to operate on the console. The console operator is provided with a three position switch, normally set to "standby," which would be moved to "listen" to hear the customer, or "talk" to give instructions. In the "standby" mode, all intercom inhibits are held on, while in the "listen" mode, the console receiver and pump transmitter inhibits are lifted.

On "speak," the console transmitter and pump receiver are enabled. Two control bits are therefore required in the data assembly; these are provided as described in the previous section.

Figure 6:
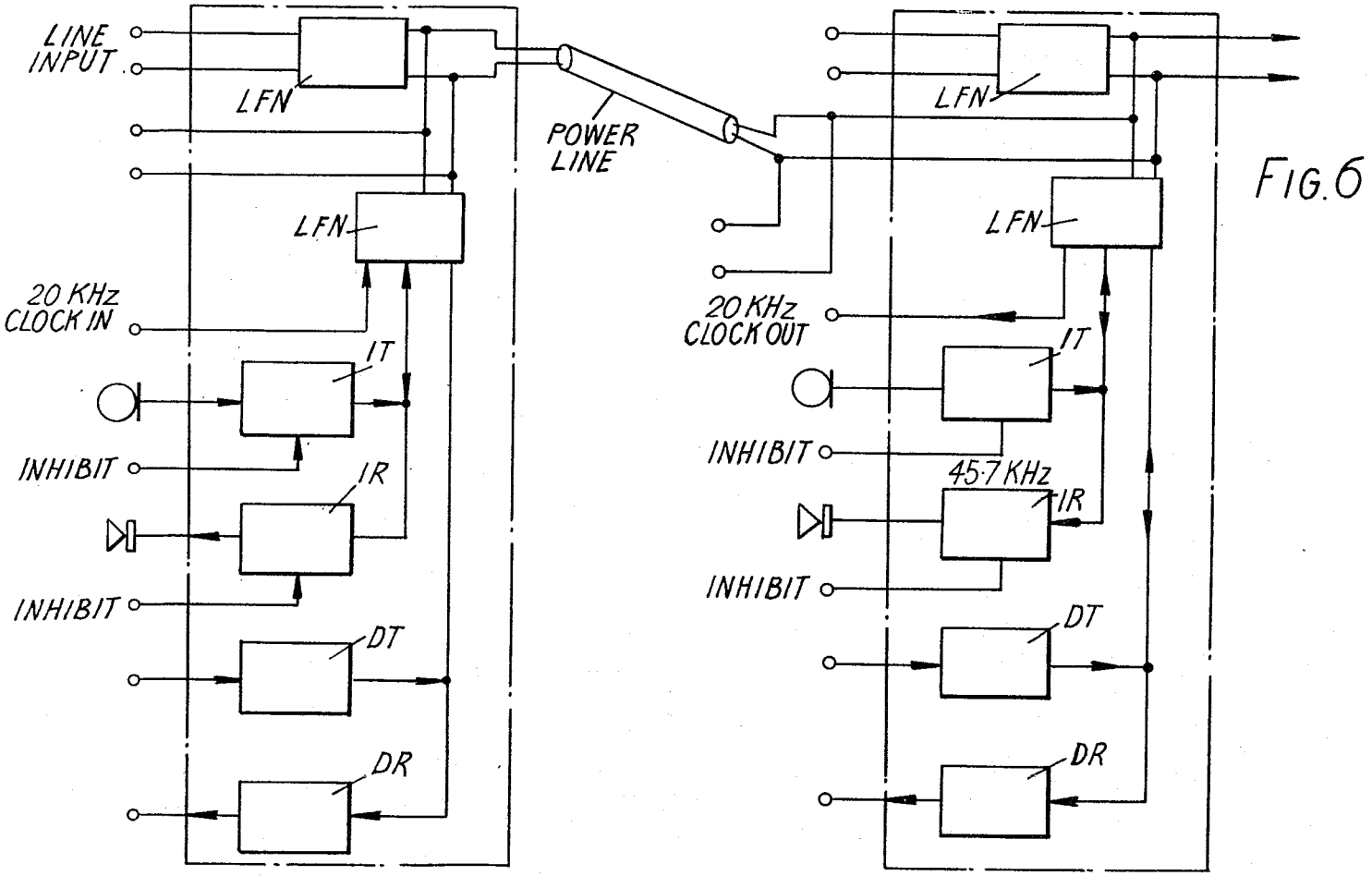
FIG. 6 is a block diagram illustrating the communication organisation of the system.

The individual system components appearing in FIG. 6 will now be described in greater detail.

Figure 7:
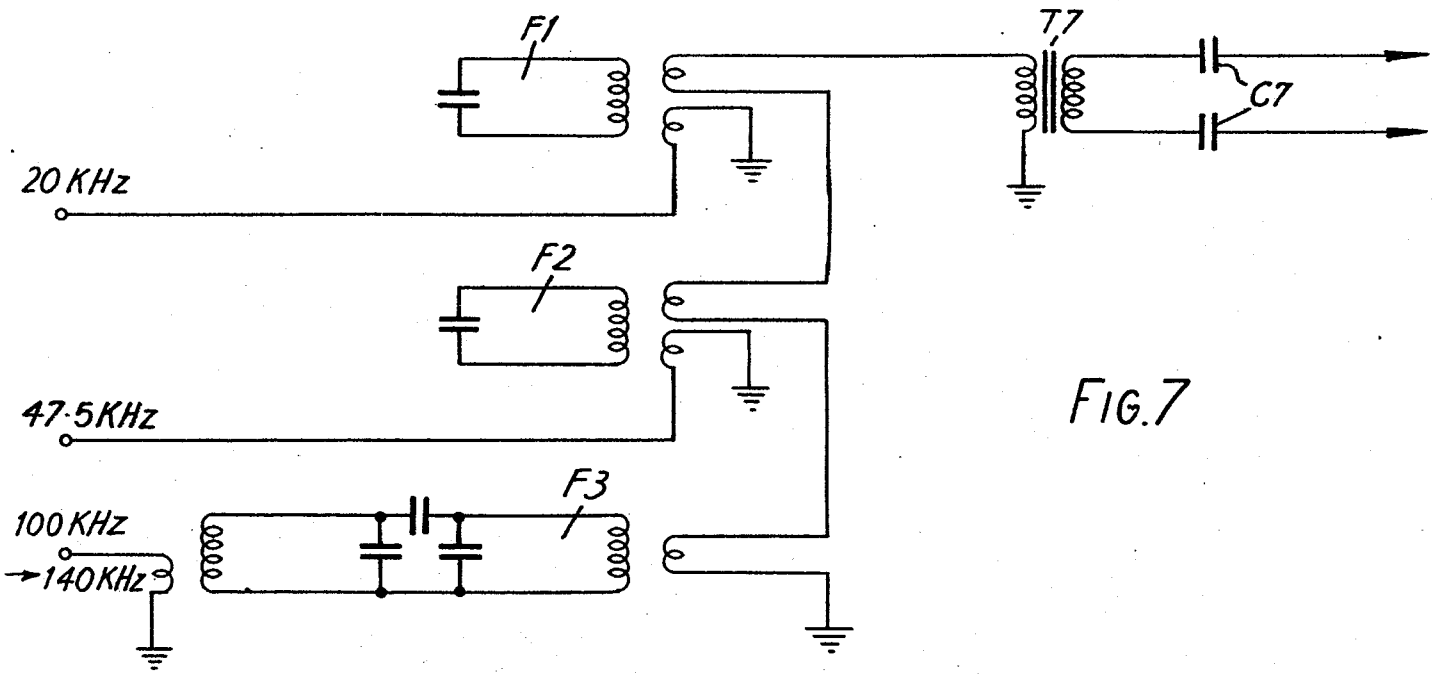
FIG. 7 is a schematic circuit diagram illustrating the manner in which the data signals are impressed on to the power lines in the system.

Line filtering networks LFN are required to remove all interference within the three communication passbands. The solution employed is to use proprietary broad band filters with additional frequency selective elements as required. Effective mains supply filtering is considered to be essential, not only for the datalink, but also to ensure correct operation of the pump and console logic circuitry. FIG. 7 shows schematically the arrangement for each interfacing and multiplexing unit LFN of FIG. 6. Line interfacing and multiplexing is carried out in two stages; first a broad band network of transformers and capacitors T7, C7 eliminates the 50/60 Hz line frequency signals and then individual filter networks F1, F2 and F3 split the incoming and outgoing signals into the three required bands.

Figure 8:
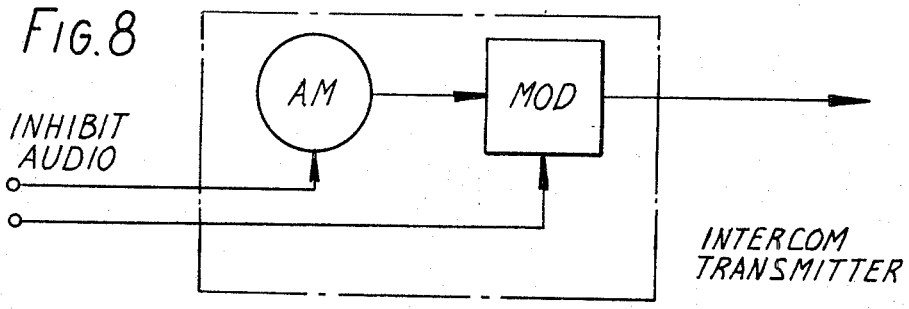
FIG. 8 is a schematic diagram of the audio transmitter/receiver arrangement.
Figure 8:
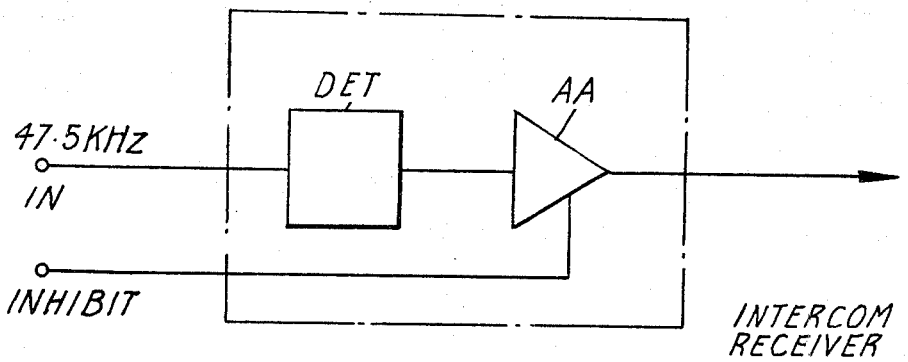

FIG. 8 outlines the principal components of the intercom transmitter/receiver. An astable multivibrator AM drives an amplitude modulator MOD and unwanted harmonics of 47.5 kHz are removed by the multiplexing circuitry. The receiver consists of an envelope detector DET driving an audio amplifier AA.

Figure 9:
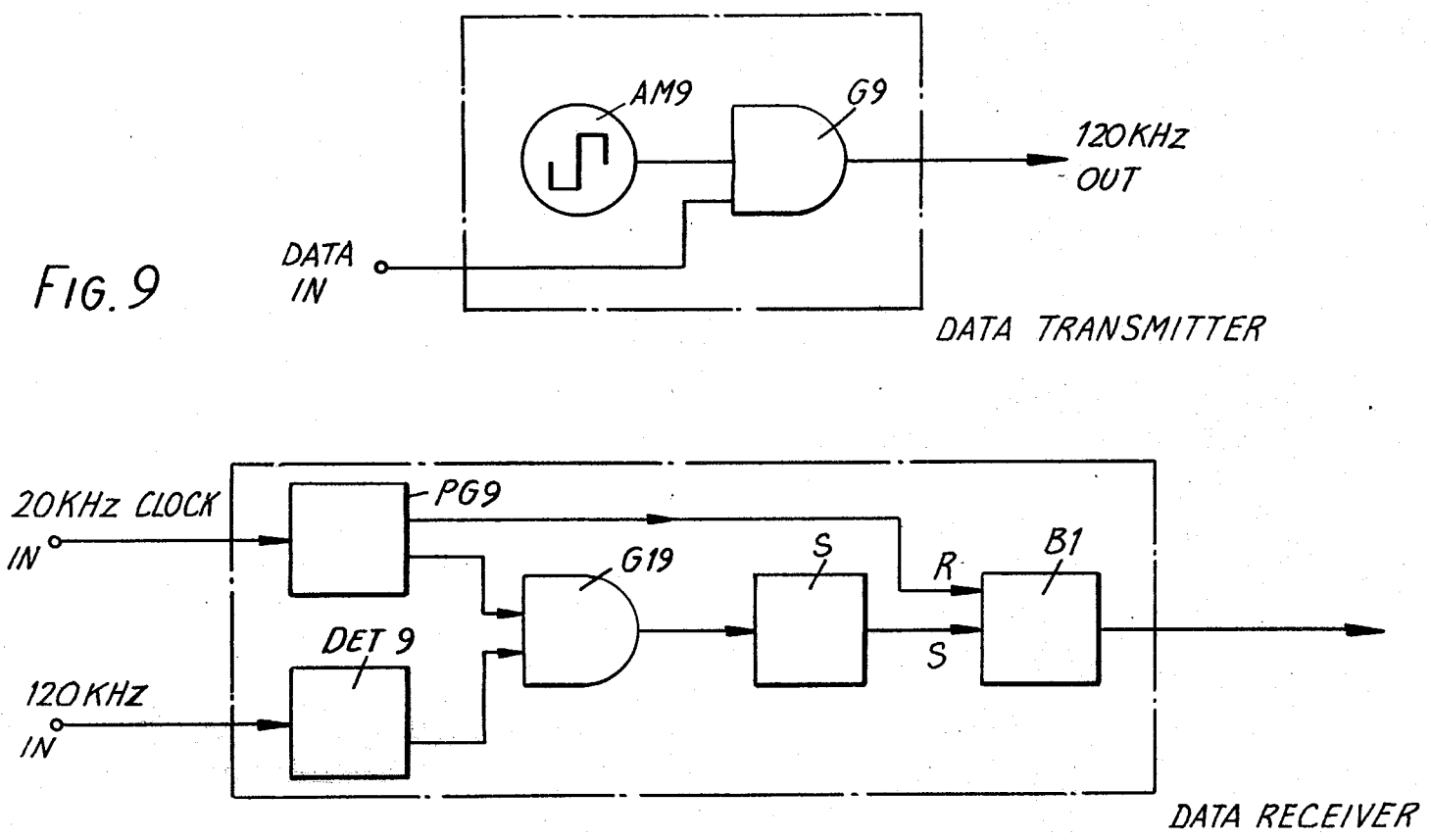
FIG. 9 is a schematic diagram of a data transmitter/-receiver of the system.

The data transmitter, shown in FIG. 9, is a 120 kHz astable multivibrator AM9 gated by the data stream by means of a gate G9. Unwanted harmonics are again removed by the multiplexing network.

The data receiver, again shown in FIG. 9, accepts 20 kHz clock input applied to a pulse generator PG9. The receiver generates short pulses coincident with the centres of the incoming bits. A detector DET9 receives 120kHz pulses and applied an output to a gate G19 which is controlled by the output from DG9. A stream of samples is therefore produced which are applied to a Schmitt threshold circuit S9. If the Schmitt trigger circuit is triggered, then the receiver has decided a logical 1 is present and an output bistable B9 is set to 1. 50 uS later, a reset pulse is generated, returning the bistable output to zero. In this way, a retimed and reconstructed version of the input bit stream is generated, with high system immunity to noise and other interfering signals.

Figure 10:
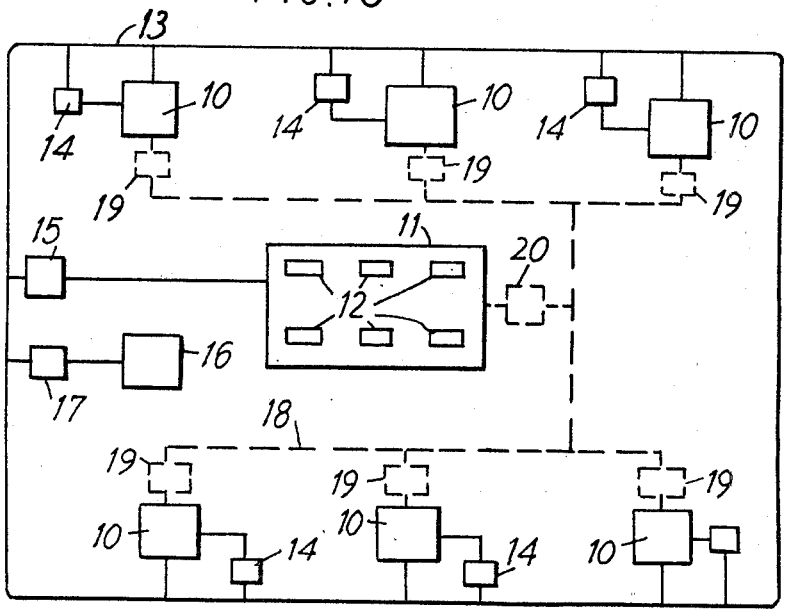
FIG. 10 is a schematic in plan view of a layout of a petrol station embodying the invention.

Referring now to FIG. 10 there is shown schematically in plan view the layout of a petrol station embodying the invention. Six petrol pumps 10 are shown and the central control is shown at 11, having cashier displays 12, in this case one display for each pump. The mains supply line for the pump motors is shown as a ring main 13 and this is used as the data link. Each pump has a multiplex interface unit 14 whereby data is transmitted to and from the pump. Similarly, the central control has a multiplex interface unit 15. A banknote validator 16 is provided for use when the station is unattended. The validator has a multiplex interface unit 17.

The connections in broken line show an alternative data link 18 which does not employ the mains cable. Pump interface units 19 and the central control interface unit 20 are shown for the alternative data link arrangement. We claim:

1. A liquid fuel dispensing system comprising a plurality of liquid fuel dispensing pumps each having a fuel meter, an electric pulse transmitter associated with the fuel meter of each pump to generate pulses representative of the volume of fuel dispensed, a central control, a data transmission link between each pump and the central control whereby information may be transmitted from the pump to the central control representative of the volume of fuel dispensed, a pulse store at each pump which accummulates pulses transmitted by the associated pulse transmitter in a dispensing operation, and sampling means at the central control which repetitively samples the output from the pulse stores to derive inputs representative of the volumes dispensed, which inputs are updated at each sampling.

2. A liquid fuel dispensing system as claimed in claim 1 wherein there is a single data transmission link and a multiplex transmission system is employed.

3. A liquid fuel dispensing system as claimed in claim 2 wherein the data transmission link is the power supply network for the pumps.

4. A liquid fuel dispensing system as claimed in claim 2 wherein the multiplex transmission system is a time-division multiplex system and sampling is effected cyclically in a serial manner.

5. A liquid fuel dispensing system as claimed in claim 4 wherein the sampling means comprises an interrogator which cyclically interrogates the pump pulse stores and the pump pulse stores have associated responders which respond on being identified in the interrogation to transmit information from the pulse store to the central control.

6. A liquid fuel dispensing system as claimed in claim 4 wherein the time-division multiplex operation is synchronised by a series of clock pulses at a fixed frequency transmitted over the data link; a voice communication system is provided over the data link modulated on a high carrier frequency; and digital data words conveying pump information and instructions are modulated on a further carrier frequency, the pumps and the central control having frequency filters for dividing the information carried in the three frequency ranges.

7. A liquid fuel dispensing system as claimed in claim 6 wherein the clock frequency is 20 kHz; the voice carrier frequency is 47.5 kHz and the digital data word carrier frequency is 120 kHz.

8. A liquid fuel dispensing system as claimed in claim 6 wherein each digital data word comprises 100 bits of information and is 5 ms long.

9. A liquid fuel dispensing system as claimed in claim 1 wherein the pulse store at each pump comprises a recirculating shift register which carries a digital data word including the totals of pulses representative of volume dispensed and cost of the fuel dispensed.

10. A liquid fuel dispensing system as claimed in claim 9 wherein at least one of said pumps is of the blending kind, wherein a required blend of two base grades of fuel may be selected by the operator, means within said at least one blending pump for producing a signal indicative of a blending error, the said at least one blending pump thereby producing an output representative of any blending error which occurs during dispensing and the digital data word includes a representation of the blending error.

11. A liquid fuel dispensing system as claimed in claim 10 wherein at the central control there are provided volume stores for recording the total volumes of base grades of fuel dispensed, the volume stores receiving respective inputs derived from the digital word parts representative of the total volume of fuel dispensed, the blending error and the blend selected by the operator.

* * * * *